US007802500B2

(12) United States Patent
Kolodziej et al.

(10) Patent No.: US 7,802,500 B2
(45) Date of Patent: Sep. 28, 2010

(54) PNEUMATIC FASTENER DRIVING TOOL

(75) Inventors: Norbert K. Kolodziej, Park Ridge, IL (US); Kevin M. Tucker, Chicago, IL (US); Yongping Gong, Glenview, IL (US); Louis Thomas, Maywood, IL (US); Cheryl L. Panasik, Elburn, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 9 days.

(21) Appl. No.: 11/964,335

(22) Filed: Dec. 26, 2007

(65) Prior Publication Data

US 2009/0165600 A1 Jul. 2, 2009

(51) Int. Cl.
*B25B 21/00* (2006.01)
*B25B 23/04* (2006.01)

(52) U.S. Cl. ..... 81/434; 81/57.44

(58) Field of Classification Search ..... 81/57.33, 81/434, 57.44, 430–433, 435
See application file for complete search history.

(56) References Cited

U.S. PATENT DOCUMENTS 4,763,562 A 8/1988 Haytayan
5,044,225 A * 9/1991 Louw ..... 81/430
5,058,464 A * 10/1991 McGovern et al. ..... 81/57.41
5,165,311 A * 11/1992 Louw ..... 81/430
5,862,724 A 1/1999 Arata et al.
6,026,713 A * 2/2000 Ohmori et al. ..... 81/57.44
6,061,901 A * 5/2000 Tanaka ..... 29/798
6,073,521 A * 6/2000 Uno et al. ..... 81/57.44
6,158,643 A * 12/2000 Phillips ..... 227/130
6,260,519 B1 * 7/2001 Phillips ..... 123/46 R
6,604,664 B2 * 8/2003 Robinson ..... 227/8
6,782,957 B2 * 8/2004 Fujiyama ..... 173/93.5
6,843,400 B1 * 1/2005 Lee ..... 227/8
6,942,042 B2 * 9/2005 Lee ..... 173/11
7,013,985 B2 3/2006 Sasaki et al.
2005/0098333 A1 5/2005 Lee

* cited by examiner

*Primary Examiner*—David B Thomas
(74) *Attorney, Agent, or Firm*—Levenfeld Pearlstein, LLC

(57) ABSTRACT

A pneumatic fastener driving tool is configured to drive a threaded fastener using both linear and rotational motion. The tool allows a fastener to first be driven linearly, without rotation, through a surface material and into a substrate material, preferably to a depth that causes the fastener to at least pierce the substrate material. The tool then rotates the threaded fastener and causes it to fully engage the substrate material, thereby fastening the surface material to the substrate material. The tool has sufficient linear force to drive a fastener into relatively hard substrate materials, such as steel studs, and has a stationary air motor assembly to reduce recoil generated during the driving process. The tool further comprises a gear reducer assembly that uses a compound planetary gear in order to reduce the overall length of the tool.

22 Claims, 10 Drawing Sheets

PNEUMATIC FASTENER DRIVING TOOL

BACKGROUND OF THE INVENTION

The present invention relates generally to fastener driving tools, and more particularly to an improved fastener driving tool configured to drive a threaded fastener using both linear and rotational motion.

Threaded screw fasteners are well known in the art and are widely used for numerous fastening applications. In one such application, threaded screw fasteners are used to fasten a surface material, such as exterior gypsum sheathing or interior drywall, to a substrate material, such as steel or wood framing elements (studs).

Threaded screw fasteners may be driven using any of a variety of prior art fastener driving tools, such as manual screwdrivers and powered driving tools, such as screw guns. Powered driving tools, which are commonly used in the construction industry, may be powered by various means, such as electrically, pneumatically, by combustion or by combinations of the foregoing.

In high production settings, threaded screw fasteners may be stored in a carrier strip which feeds the fasteners to the powered driving tool in a continuous, rapid fashion. Such carrier strips generally comprise a plurality of evenly spaced apertures through which the screws extend transversely with the fastener heads resting near or against the carrier strip. In this manner, the fasteners may be quickly fed to the powered driving tool which engages each fastener in the carrier strip and, by linear and/or rotational movement, detaches the fastener from the strip and drives it into the material.

One challenge faced by installers is that, upon driving the fastener, the generally large diameter head of the fastener should be flush with, but not pierce the face paper outer layer of the surface material. If the fastener passes through the face paper, the board is structurally weakened at that point, and may require additional finishing.

Another challenge faced by installers is that when the surface material is applied to substrate material, the fastener typically easily passes through the relatively soft surface material, but in some cases has difficulty penetrating the harder substrate material. Therefore, when driving fasteners into a relatively hard substrate materials, additional force is required to cause the fastener to penetrate the substrate material and to engage the threads of the fastener with the substrate material.

Even when special cutting- or drill tip-type fasteners are used, the substrate material sometimes may be pushed away from the rear surface of the surface material. Thus, in some cases, the fastener may pierce the substrate material on an angle relative to the surface material. Subsequent tightening of the fastener therefore may fail to form a tight connection between the surface material and the substrate material at that point.

Additionally, because the process of rotationally driving a threaded screw fastener for the entire length of the fastener shank adds time to the fastener driving process, it would be advantageous to reduce to number of rotations required to drive the fastener. For, in a high production setting, even a small amount of time saved when each fastener is driven can add up to a significant time savings over the course of hundreds or thousands of fasteners.

The prior art has developed tools designed to address some of these challenges. Powered driving tools configured to engage a threaded screw fastener stored in a carrier strip, separate the individual fastener from the carrier strip by linear motion (that is, motion in the direction of the longitudinal axis of the fastener) and drive the fastener into a material using rotational motion are known in the art.

For example, U.S. Pat. No. 5,862,724 to Arata et al. discloses a pneumatic fastener driving tool having both linear and rotational driving functions. In the disclosed tool, a driver blade is disposed within a cylinder and is driven both linearly (by a piston) and rotatably (by an air motor). The air motor (and its associated planetary reduction gear system) travels with the driver bit as it reciprocates in the cylinder.

One drawback of the disclosed tool, however, is that it has insufficient power to drive a fastener into harder substrate materials, such as a light gauge steel studs, which are commonly used in the construction industry.

Still another drawback of the disclosed tool is the relatively high recoil generated by the tool as a result of the linear, reciprocating movement of not just the driver blade, but also the air motor, the planetary reduction gear system and the multiple pistons, within the tool. The significant recoil generated by this prior art tool can disengage the fastener-driving bit from the fastener head. In such cases, a separate tool such as a power screwdriver is needed to complete fastener installation.

Thus, there is a need for a powered fastener driving tool which addresses the above-identified drawbacks of prior art fastener driving tools. Desirably, such a tool is configured to drive a fastener using both linear and rotational movement, effectively acting both as a nail gun and as a screw gun. More desirably, such a tool has sufficient linear force to drive a fastener into a relatively hard substrate, such as a steel stud. More desirably still, such a tool comprises an air motor assembly and a gear reducer assembly that do not travel linearly within the tool in order to reduce recoil generated during the driving process. Even more desirably, such a tool uses a compound planetary gear reducer assembly to advantageously reduce the overall length of the tool. Most desirably, such a tool is pneumatically powered and may be used with numerous prior art air compressors.

BRIEF SUMMARY OF THE INVENTION

The present invention comprises a pneumatic fastener driving tool configured to drive a threaded fastener using both linear and rotational motion. The tool allows a fastener to first be driven linearly, without rotation, through a surface material and into a substrate material, preferably to a depth that causes the fastener to at least pierce the substrate material. The tool then rotates the threaded fastener and causes it to fully engage the substrate material, thereby fastening the surface material to the substrate material.

The tool comprises a housing formed with an integral handle. The handle is configured to receive source of pressurized air, such as an air compressor as is known in the art for use in powering pneumatically-driven tools, and to act as reservoir of compressed air to be used by the tool. The handle further comprises a trigger configured to activate the tool when the trigger is depressed. The handle may further include a magazine connector for attaching a magazine assembly for feeding multiple fasteners to the tool.

Disposed within the housing are the primary components of the tool: a poppet valve assembly, a driver blade assembly, an air chamber, a spool valve assembly, an air motor assembly and a gear reducer assembly.

In the preferred embodiment, the poppet valve assembly comprises a poppet valve as is well known in the art. The poppet valve is configured to sealingly engage the air chamber when in the closed position. The poppet valve is biased in the closed position by the force of pressurized air acting against its top surface. When the source of pressurized air is terminated, such as when the trigger is depressed in order to activate the tool, the resulting change in pneumatic forces causes the poppet valve to open, thereby allowing a source of pressurized air to enter the air chamber to drive the driver blade assembly in the air chamber.

The driver blade assembly in the preferred embodiment comprises a piston having an axial bore formed therein. A driver blade extends through the piston and is rotatably mounted to the piston using a bushing disposed in the bore. In this manner, the driver blade may rotate within the piston while the piston itself does not rotate. In addition, limited linear (axial) movement of the driver blade through the piston is provided through a spring-biased locking mechanism.

Preferably, the driver blade is configured with a geometrically-keyed profile to engage the gear reducer assembly in order to cause rotation of the driver blade, as further described herein. The driver blade is further configured to receive a driving bit for engaging the head of fastener.

The driver blade assembly is disposed within the air chamber such that the piston can move in a linear, reciprocating manner within the air chamber, between the rear of the air chamber and the front of the air chamber, thereby moving driver blade in a linear, reciprocating manner through the air chamber, the air motor assembly and the gear reducer assembly. The piston sealingly engages the air chamber using an O-ring disposed in annular groove formed around the circumference of the piston.

The air chamber is a generally cylindrical chamber and that is disposed within the central portion of the housing, between the poppet valve assembly and the air motor assembly. The air chamber is configured with a plurality of openings along its length, the openings leading to cavities and channels (passageways) formed in the housing and configured to transport air within the tool.

As the piston reciprocates in the air chamber, the openings permit the air driving the piston to enter the cavities and channels and to be delivered other areas of the tool, for example to provide a source of air to drive the air motor assembly when rotational movement of the fastener is required, or to otherwise be exhausted from the air chamber.

A spool valve assembly, as is known in the art, is disposed between the air chamber and the air motor assembly. The spool valve assembly is configured to control the flow of pressurized air to the air motor assembly such that as the piston is driven to the front end of the air chamber, the spool valve assembly cuts off the flow of pressurized air to the air motor, causing the air motor to stop.

The air motor assembly is disposed between the spool valve assembly and the gear reducer assembly. Unlike air motor assemblies in prior art pneumatic fastener driving tools, the air motor assembly of the present invention is advantageously fixed in a stationary location in the housing. The air motor assembly does not travel linearly within the tool, thereby reducing recoil generated during operation of the tool.

The air motor assembly preferably comprises a cylindrical sleeve within which a finned rotor is disposed and coaxially mounted on a drive shaft. Compressed air enters the cylinder through openings formed in the cylinder and exerts pressure on the fins causing the rotor to rotate, thereby rotatably driving the drive shaft. The drive shaft is formed with an axial bore for receiving the driver blade and allowing the driver blade to pass through, and independently rotate within, the air motor assembly.

Preferably, the air motor assembly is operably engaged with the adjacent gear reducer assembly to form an integral unit. The gear reducer assembly is configured to transmit the rotational force of the air motor assembly drive shaft to the driver blade while at the same time effectively reducing the rotational speed and increasing torque of the drive shaft. The operation of such gear reducers is generally well known in the art. However, unlike gear reducer assemblies as used in the prior art pneumatic fastener driving tools, the gear reducer assembly of the present invention is advantageously fixed in a stationary location in the housing. The gear reducer assembly does not travel linearly within the tool, thereby reducing recoil generated during operation of the tool.

In the preferred embodiment, the gear reducer assembly of the present invention comprises a pair of compound planetary gears mounted on a carrier and disposed within a ring gear. The compound planetary gears are driven by the drive shaft of the air motor assembly (acting as the sun gear). The carrier is operatively connected to an output gear. The output gear is formed with a D-shaped axial bore configured to matingly engage the driver blade such that the driver blade is rotational driven by the output gear while the driver blade may linearly (axially) move through the output gear.

A nose piece is disposed at the front of the tool housing and defines a passage through which the driver blade exits the housing during actuation of the tool. A workpiece contact assembly is mounted to the nose piece and is configured to engage the exterior surface of the surface material and to provide a passage through which the driver blade (with the driving bit mounted thereon) may pass, engage a fastener supplied by the magazine assembly, linearly drive the fastener through the workpiece assembly and into the surface and substrate materials and then rotationally drive the fastener into the surface and substrate materials.

A depth adjustment assembly is also preferably mounted to the housing to permit adjustment of the distance that the fastener is driven into the surface and substrate materials.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
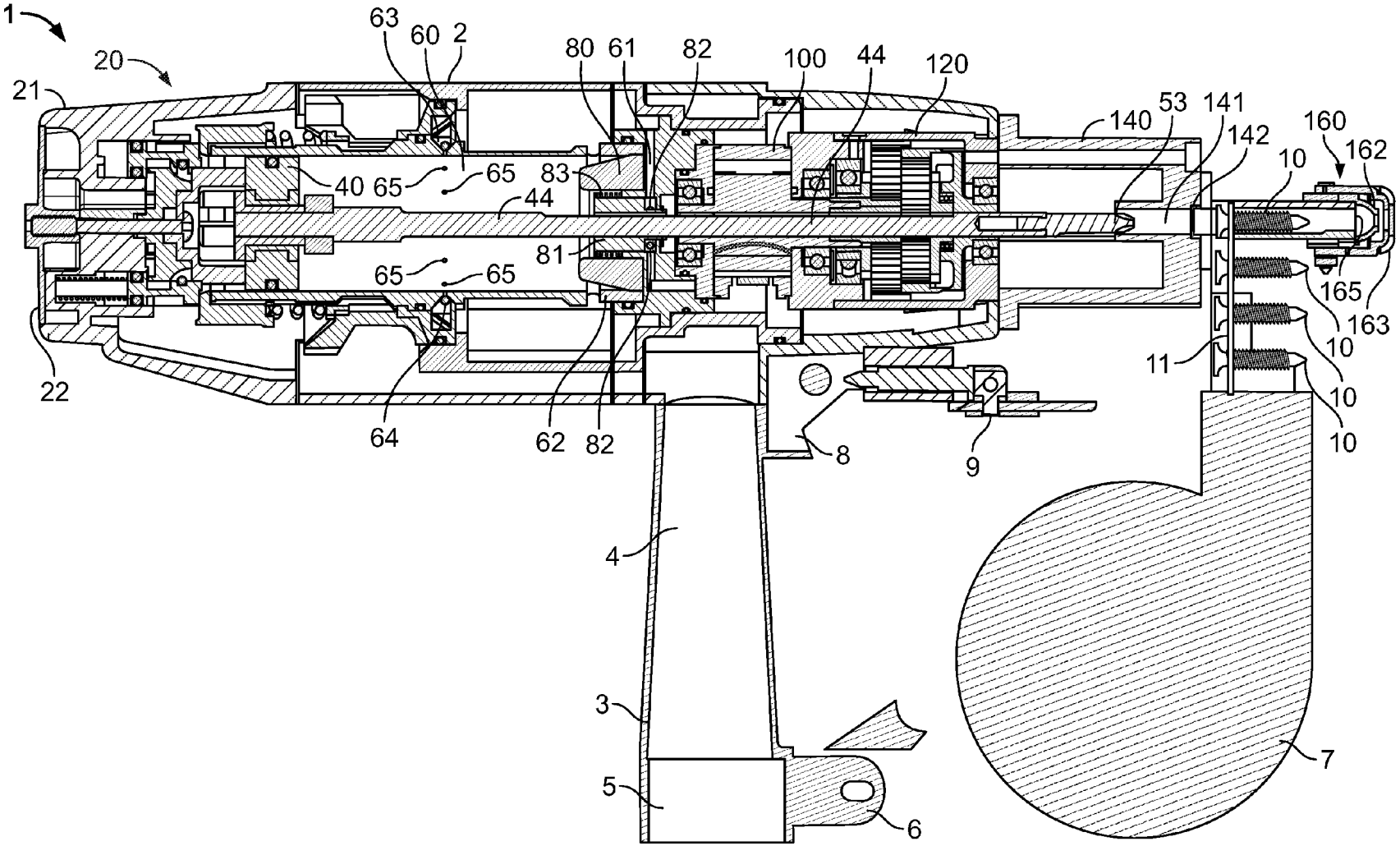
FIG. 1 is a cross sectional view of the pneumatic fastener driving tool embodying the principles of the present invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention," relates to a requirement of the United States Patent Office, and does not imply, nor should be inferred to limit the subject matter disclosed herein.

As shown in FIG. 1, the pneumatic fastener driving tool 1 of the present invention generally comprises a housing 2 within which the primary components of tool 1 are disposed: a poppet valve assembly 20, a driver blade assembly 40, an air chamber 60, a spool valve assembly 80, an air motor assembly 100 and a gear reducer assembly 120.

Housing 2 includes an integral handle 3 extending downwardly therefrom and having a hollow interior cavity 4 formed therein. The bottom of handle 3 is configured with an adapter 5 for receiving a source of pressurized air, such as an air compressor (not shown) as is well known in the prior art, typically through a flexible hose (not shown). Handle 3 preferably is further configured with a connector 6 for detachably connecting a fastener magazine 7 to tool 1 (magazine 7 is shown detached from tool 1 in FIG. 1). However, it will be appreciated by those skilled in the art that magazine 7 may be connected to handle 3 or housing 2 using various methods.

Fastener magazine 7 serves a source of fasteners for tool 1 and generally is configured to store a plurality of fasteners 10 disposed on a carrier strip 11. Carrier strip 11 typically comprises a plurality of evenly spaced apertures through which fasteners 10 extend transversely with the fastener heads resting near or against carrier strip 11. In this manner, fasteners 10 may be fed to tool 1 in a rapid and repetitive manner. The design and operation of fastener magazine 7 is well known in the art. While a rotary fastener magazine 7 is depicted, it will be appreciated that other magazine configurations are contemplated, including but not limited to linearly operating or strip magazines as are known to those skilled in the art.

Handle 3 further comprises a trigger 8 configured to activate the tool when trigger 8 is depressed. The design and operation of trigger 8 is well known to those skilled in the art of pneumatically-powered tools and generally comprises a valve member (not shown) configured to direct pressurized air from the air source to certain parts of tool 1 when tool 1 is in a "non-actuated" state and direct pressured air to other parts of tool 1 when tool 1 is in an "actuated" state, as further discussed below.

Figure 2A:
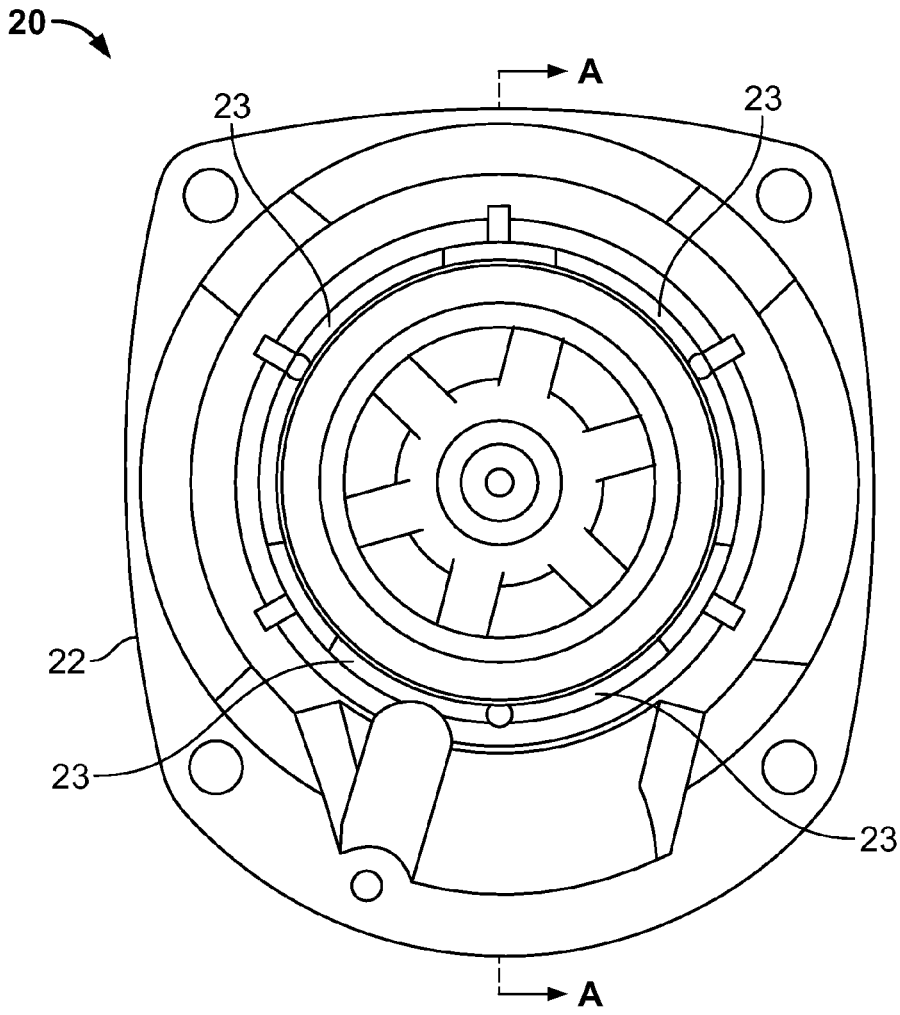
FIG. 2A is an enlarged, rear view of the poppet valve assembly.
Figure 3A:
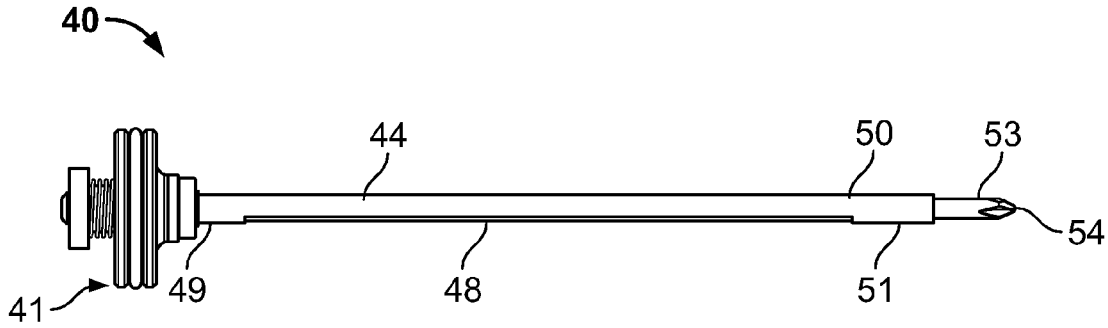
FIG. 3A is a side view of the of the driver blade assembly.
Figure 2B:
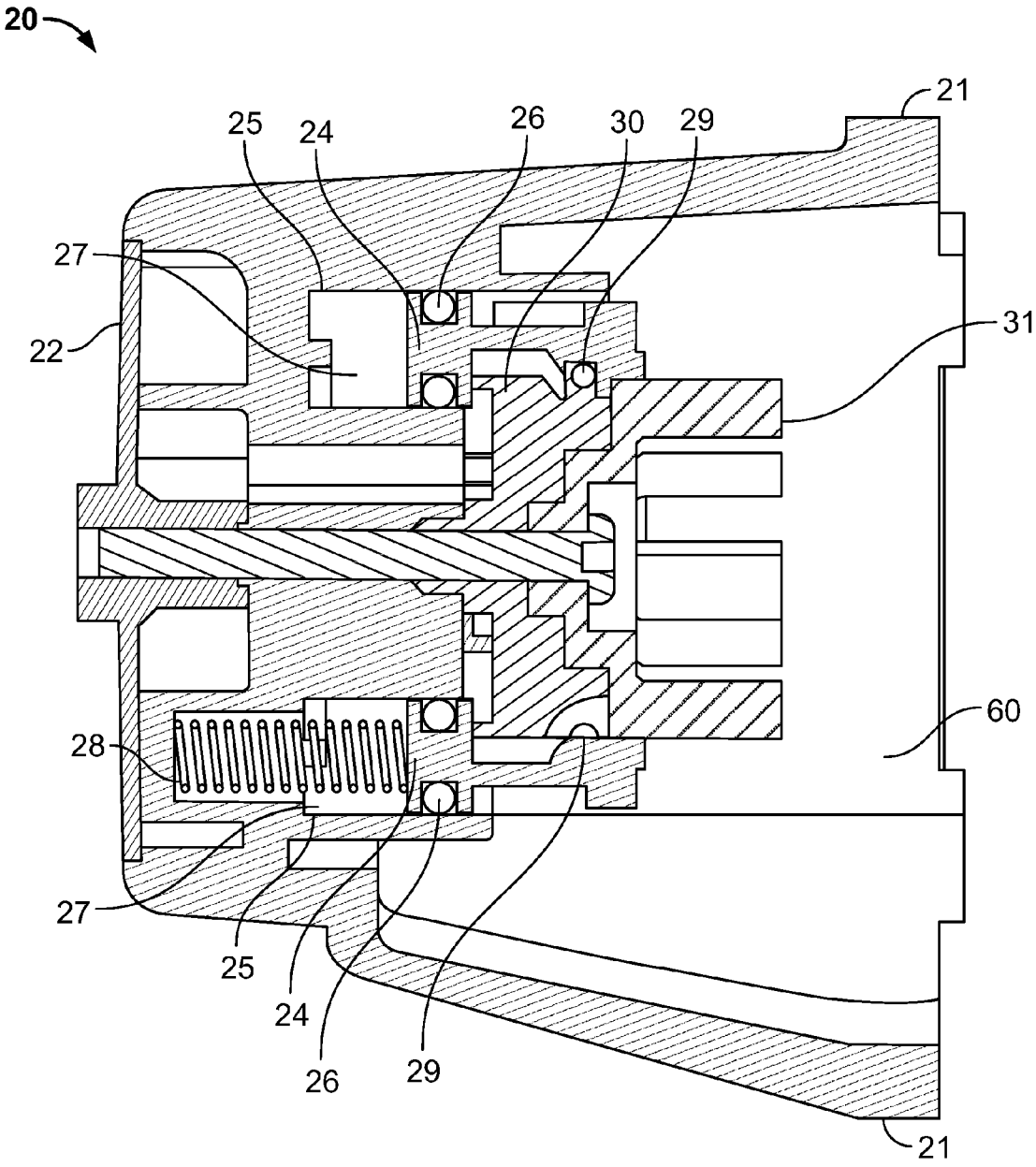
FIG. 2B is a sectional view taken along the line A-A of the poppet valve assembly of FIG. 2A.
Figure 3B:
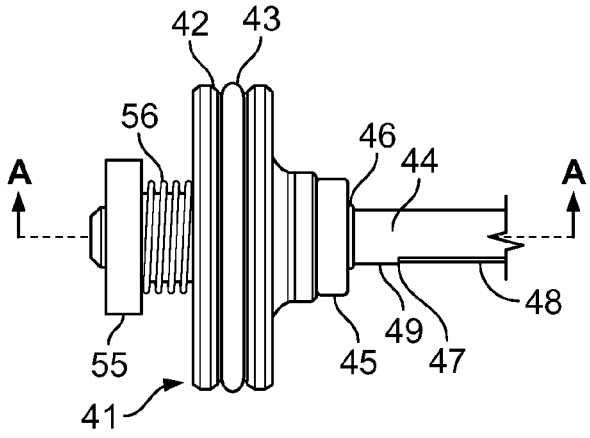
FIG. 3B is a enlarged fragmentary view of the driver blade assembly of FIG. 3A.
Figure 3C:
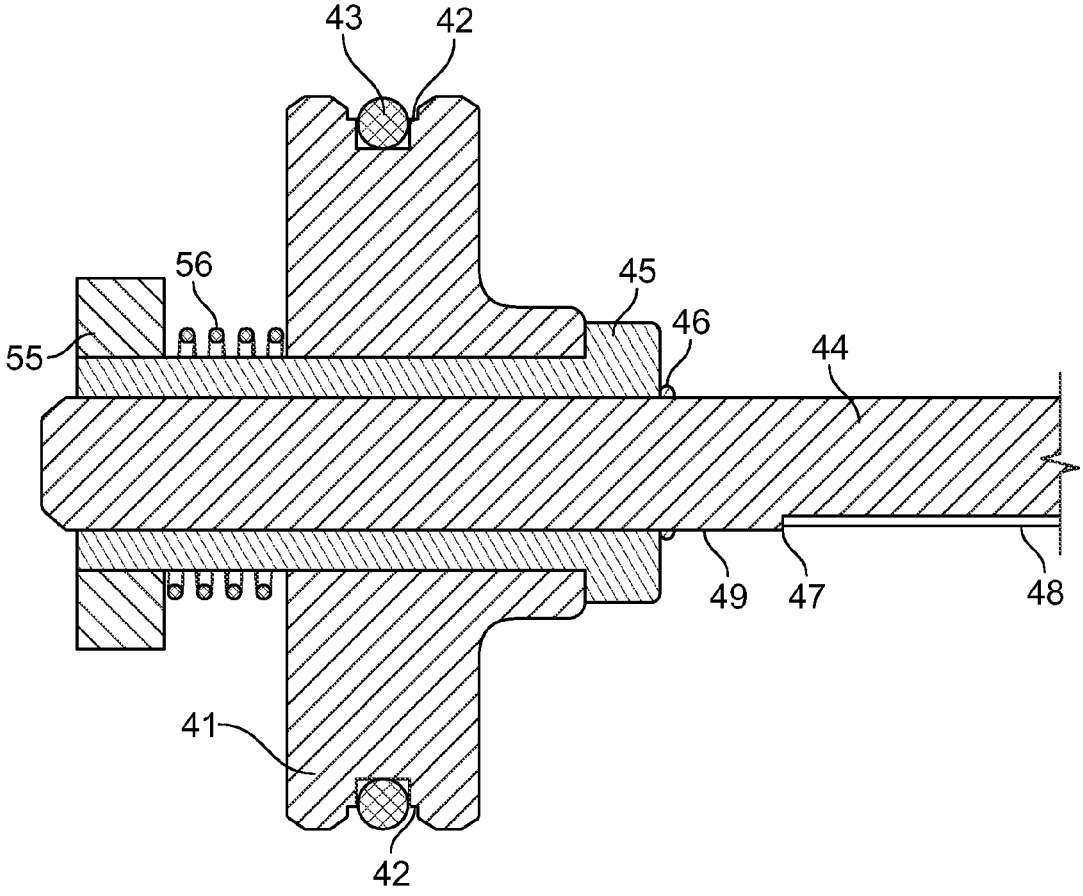
FIG. 3C is an enlarged sectional view taken along the line A-A of the driver blade assembly of FIG. 3B.
Figure 4A:
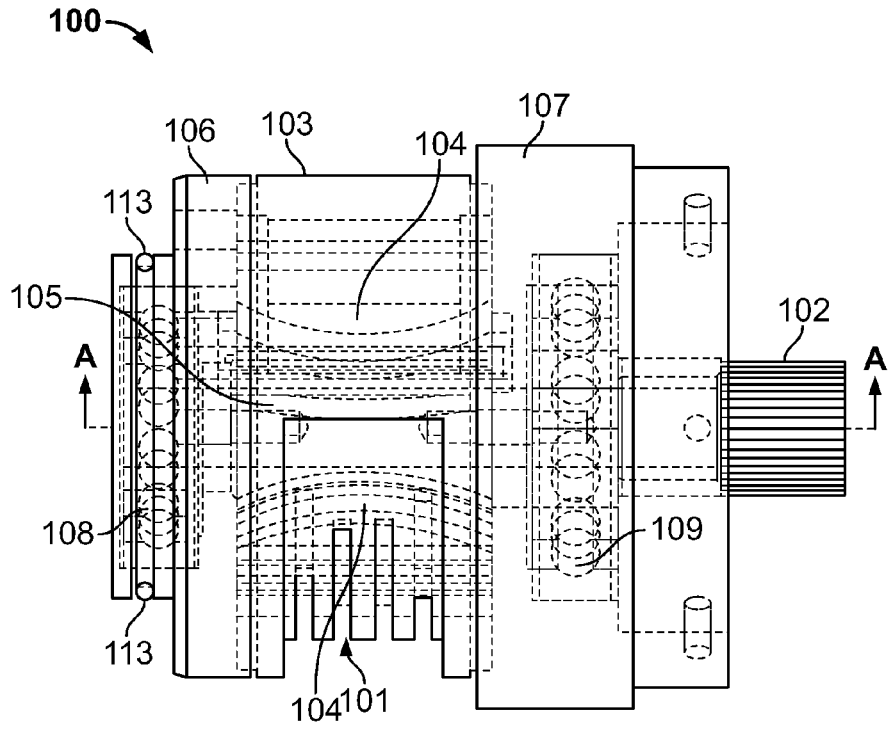
FIG. 4A is an enlarged, transparent schematic side view of the air motor assembly.
Figure 4B:
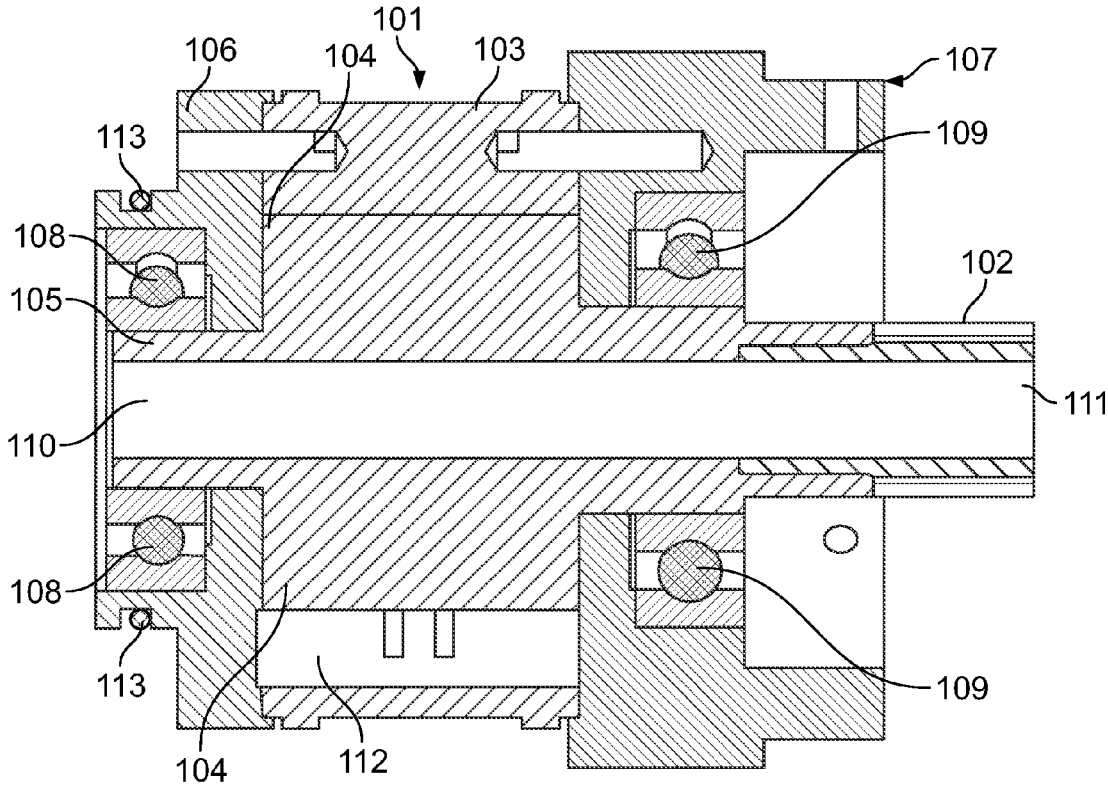
FIG. 4B is a sectional view taken along the line A-A of the air motor assembly of FIG. 4A.
Figure 4C:
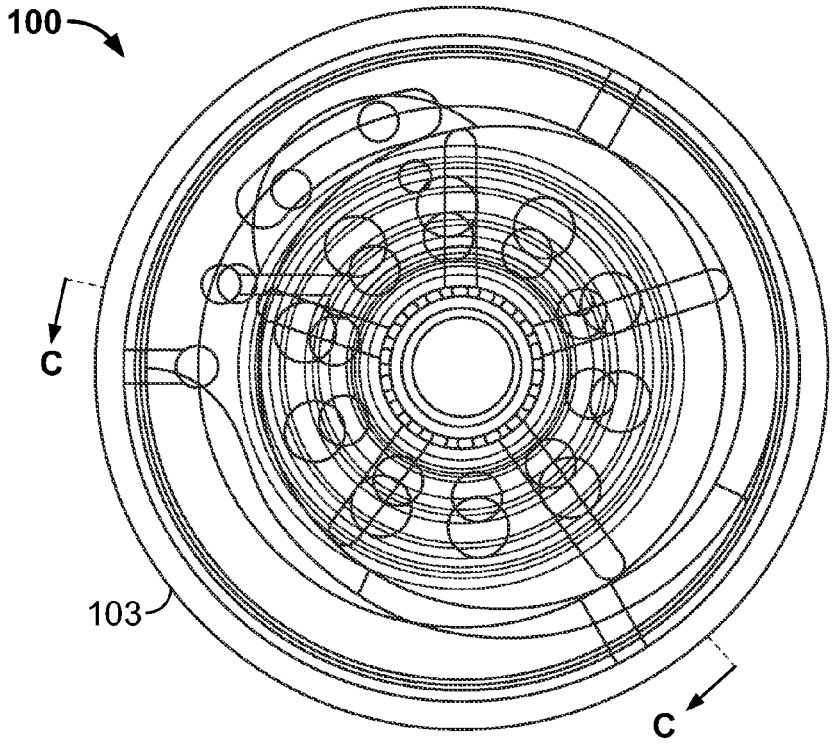
FIG. 4C is an enlarged, transparent schematic front view of the air motor assembly.
Figure 4D:
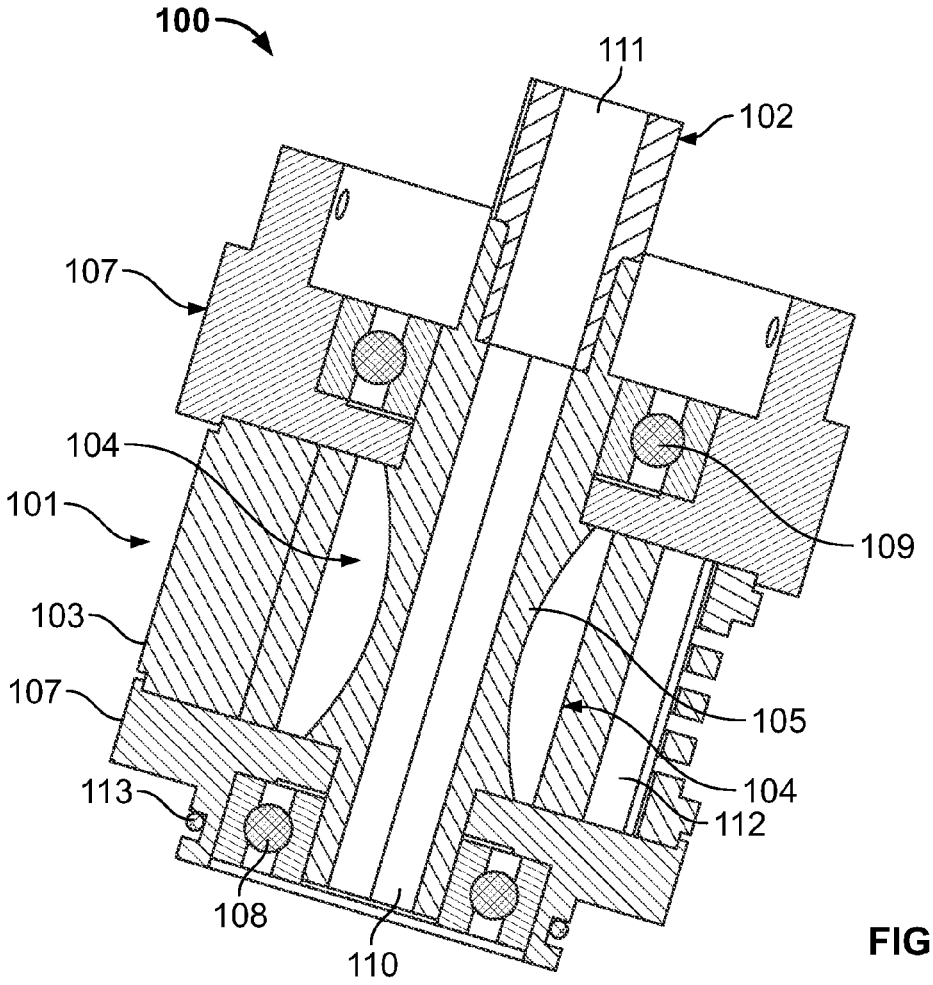
FIG. 4D is a sectional view taken along the line C-C of the air motor assembly of FIG. 4C.

As shown in FIGS. 1, 2A and 2B, in the preferred embodiment of the present invention poppet valve assembly 20 comprises a cap member 21 removably connected to housing 2 of tool 1. An exhaust plate 22 is mounted to the end of cap member 21 and is configured to permit the exhaust of air from air chamber 60 through vents 23 after a fastener has been driven and the tool 1 is returned to a "non-actuated" state, as further discussed below.

Within cap member 21, a poppet valve 24 is slidably disposed within a sleeve 25. Poppet valve 24 is sealingly engaged with sleeve 25 through O-rings 26. In its closed position (as shown in FIGS. 1 and 2B), poppet valve 24 forms a chamber 27 configured hold a source of pressurized air directed to chamber 27 by trigger 8, as further discussed below. Poppet valve 24 is biased in its closed position by poppet spring 28 and, when tool 1 is in a "non-actuated" state, by the pressurized air disposed in chamber 27.

When poppet valve 24 is in its open position (that is, when poppet valve moves toward the rear of tool 1), an air passage is opened from chamber 27 to air chamber 60, permitted the source of pressurized air to be directed to air chamber 60, as further discussed below.

Poppet valve assembly 20 further comprises a bumper 31 configured to engage piston 41 of driver blade assembly 40 and to provide a generally resilient, compressible base against which piston 41 may strike when piston 41 returns to its starting position after tool 1 has been actuated. Bumper 31 is mounted to a bumper holder 30. An O-ring 29 provides a seal between poppet valve 24 and bumper holder 30 to prevent passage of air to air chamber 60.

As shown in FIGS. 1, 3A, 3B and 3C, driver blade assembly 40 comprises a piston 41 having an axial bore 42 extending therethrough. An annular groove 42 is formed about the circumference of piston 41 and an O-ring 43 is disposed within the groove. O-ring 43 is configured to sealingly engage piston 41 within air chamber 60 while permitting slidable movement of piston 41 within air chamber 60. That is, piston 41 drives driver blade assembly 40 in a linear, reciprocating manner within air chamber 60, between the rear of air chamber 60 and the front of air chamber 60, while driver blade 44 (discussed below) can rotate therein.

A driver blade 44 is disposed within piston 41 and extends through bore 42. Within bore 42, driver blade 44 is surrounded by a bushing 45 configured to permit the independent rotation of driver blade 44 within piston 41. In this manner, driver blade 44 may rotate within piston 41 while piston 41 itself does not rotate.

Additionally, driver blade 44 is mounted to piston 41 in a manner that permits limited linear (axial) movement of driver blade 44 through piston 41. A retaining ring 46 is fixed to driver blade 44, and locking plate 55 is attached to the proximate end of driver blade 44 with piston 41 disposed between retaining ring 46 and locking plate 55.

Retaining ring 46 and locking plate 55 serve to limit the axial movement of driver blade 44 through piston 41 by acting as stops (or limits). In its neutral state, piston 41 is biased against retaining ring 46 by spring 46 such that bushing 45 rests against retaining ring 46. Upon application of force to the top of locking plate 55 (such as by air pressure in air chamber 60 once piston 41 is fully extended in air chamber 60, as further discussed below), driver blade 44 will slide axially through piston 41 until the bottom side of locking plate 55 abuts the top side of piston 41. In this manner, the axial movement of driver blade 44 through piston 41 can serve to actuate spool valve 81 in order to control operation of air motor 101, as further discussed below.

Driver blade 44 is configured to extend through air chamber 60, a spool valve assembly 80, air motor assembly 100, gear reducer assembly 120 and partially through nose piece 140 when tool 1 is in a "non-actuated" state. When tool 1 is in an "actuated" state, driver blade 44 is driven by piston 41 through air chamber 60, spool valve assembly 80, air motor assembly 100 and gear reducer assembly 120, and out of housing 2, to drive fastener 10 as further described below.

Although driver blade 44 is a generally cylindrical member, driver blade 44 preferably is formed with three zones along its length. A first zone 49 is disposed adjacent to piston 41 at the proximate end of driver blade 44, and has a generally circular profile.

At first transition point 47, the profile of driver blade 44 changes from a generally circular profile to generally D-shaped profile (that is, a profile having both curved surface and a flat surface) forming a second zone 48. The D-shaped profile of second zone 48 is configured to engage a mating opening formed in the output gear of gear reducer assembly 120, as further discussed below, in order to rotationally drive driver blade 44. It will be appreciated by those skilled in the art that the profile of second zone 48 need not be D-shaped, as described in the preferred embodiment, and that any geometrically-keyed profile may be used.

At the distal end of driver blade 44, second zone 48 transitions to a third zone 51 at second transition point 50. Third zone 51 has a generally circular profile and is formed with an opening configured to matingly receive a driving bit 53 for driving fastener 10. Driving bit 53 is of the type well known to those in the art and comprises a tip 54 preferably configured with Phillips-style profile to engage the head of fastener 10. However, it will be appreciated that other styles and profiles of driving bit 53 may be used in connection with tool 1 of the present invention.

As shown in FIG. 1, air chamber 60 is a generally cylindrical chamber that serves as a cylinder within which piston 41 of driver blade assembly 40 travels in a linear, reciprocating matter. Air chamber 60 is sealed at its upper (proximate) end by poppet valve assembly 20 (as described above) and at its lower end by a wall 61.

Air chamber 60 preferably is formed with an annular groove 63 formed about the circumference thereof. An O-ring 64 is disposed within groove 63. A plurality of holes 65 is also formed in air chamber 60 and disposed about the circumference of air chamber 60. Holes 65 extend from the valley of groove 63 to the interior of air chamber 60 and provide a passage through which pressurized air in air chamber 60 may exit air chamber 60 by exerting pressure on O-ring 64 to slightly displace O-ring from groove 63.

In this manner, as piston 41 reciprocates in air chamber 60, holes 65 permit the pressurized air driving piston 41 to enter the cavities and channels disposed with housing 2 to be delivered other areas of tool 1, for example to provide a source of air to drive air motor assembly 100 when rotational movement of driver blade 44 is required.

A piston bumper 62 is mounted to wall 61 and extends outwardly therefrom and into air chamber 60. Much like bumper 31 of poppet valve assembly 20, piston bumper 62 is configured to engage piston 41 of driver blade assembly 40 and to provide a generally resilient, compressible surface against which piston 41 may strike when piston 41 reaches the bottom of air chamber 60. In this matter, piston bumper 62 helps absorb the force of piston 41 and reduces the recoil generated by tool 1.

Disposed behind piston bumper 62 is a spool valve assembly 80. The design and operation of spool valve assembly 80 is well known to those skilled in the art. Spool valve assembly 80 comprises a spool valve 81 having inlet ports 82. Inlet ports 82 are in pneumatic communication with air motor assembly 100 and are configured to transport pressurized air from air chamber 60 (through holes 65) to air motor 101 of air motor assembly 100 in order to drive air motor 101.

Spool valve 81 is axially moveable such that when spool valve 81 is in an "open" position, as shown in FIG. 1, pressurized air may enter inlet ports 82 to be directed to air motor 101. When spool valve 81 is in a "closed" position, such as when piston 41 reaches the bottom of air chamber 60 and driver blade 44 engages spool valve 81 (forcing spool valve 81 to move axially toward the front of tool 1), spool valve 81 prevents the flow of pressurized air from inlet ports 82 to air motor 101, thus shutting off air motor 101. Spool valve 81 is biased in the "open" position with a valve spring 82.

Both piston bumper 62 and spool valve assembly 80 are formed with axial bores extending therethrough to permit driver blade 44 to pass axially therethrough and to permit driver blade 44 to freely move, in both a linear and rotational manner, through piston bumper 62 and spool valve assembly 80.

As shown in FIGS. 1, 4A, 4B, 4C and 4D, air motor assembly 100 of the present invention is disposed within housing 2 of tool 1, between spool valve assembly 80 and gear reducer assembly 120. Air motor assembly 100 comprises in the preferred embodiment a vane-type air motor 101, and is well known to those skilled in the art.

Air motor 101 comprises an exterior, generally cylindrical sleeve 103, sealed by an upper air cap 106 and a lower air cap 107. A chamber 112 is formed in the area bounded by sleeve 103, upper air cap 106 and lower air cap 107. A plurality of vanes 104 are radially mounted on a rotatable vane shaft 105 within chamber 112. Vane shaft 105 is disposed within air motor assembly 100, and extends from upper air cap 106, through sleeve 103, to lower air cap 107. Vane shaft 105 lies in horizontal orientation, generally along the central longitudinal axis of air motor assembly 100.

A plurality of upper ball bearings 108 (disposed within a channel formed in upper air cap 106) and lower ball bearings 109 (disposed within a channel formed in lower air cap 107) extend around vane shaft 105, maintain the position of vane shaft 105 and permit vane shaft 105 to rotate within air motor assembly 100. An O-ring 113 is disposed in a groove formed upper air cop 106 in order to provide a seal to prevent air escape from air chamber 60.

At its distal end, vane shaft 105 is operably and coaxially connected to a geared drive shaft 102, such that vane shaft 105 rotatably drives drive shaft 102. Both vane shaft 105 and drive shaft 102 include axial bores (110 and 111, respectively) extending therethrough to permit passage of driver blade 44 and to allow driver blade 44 to independently move in both a linear (axial) and rotational manner in and through air motor assembly 100. Drive shaft 102 extends outwardly from air motor assembly 100 and is configured to operably engage gear reducer assembly 120 in order to drive planetary gears 123 (as further discussed below).

Air motor 101 is driven by a supply of pressurized air introduced into chamber 112 (as supplied through inlet ports 82 of spool valve 81 when rotational movement of driver blade 44 is required during the fastener driving process). Air enters chamber 112 through an inlet port (not shown) and exerts pressure on vanes 104, thereby causing vane shaft 105 to rotate. As vane shaft 105 rotates, it drives drive shaft 102. Air exits chamber 112 through an outlet port (not shown) formed in chamber 112 as vanes 104 rotate.

Advantageously, and unlike prior art pneumatic fastener driving tools, air motor assembly 100 of the present invention is fixed in a stationary location within housing 2. In this manner, air motor assembly 100 does not travel linearly within tool 1, thereby reducing recoil generated during operation of tool 1.

Figure 5A:
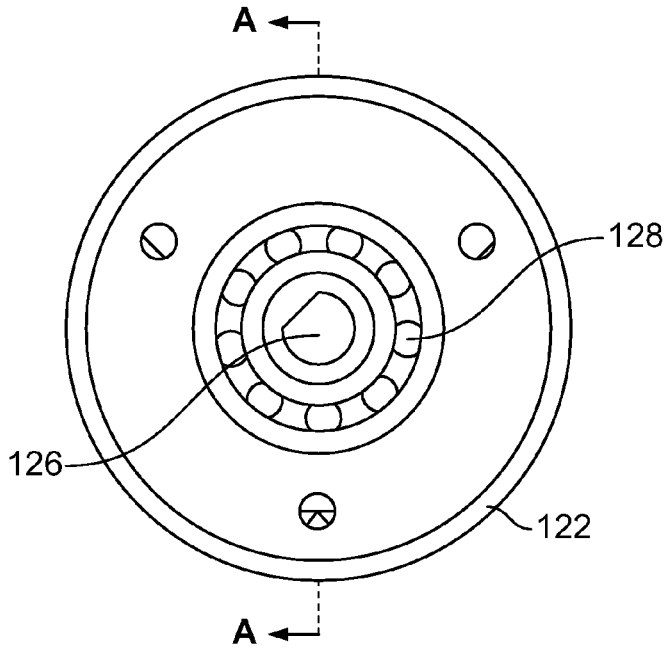
FIG. 5A is an enlarged, front view of the combined air motor assembly and gear reducer assembly.
Figure 5B:
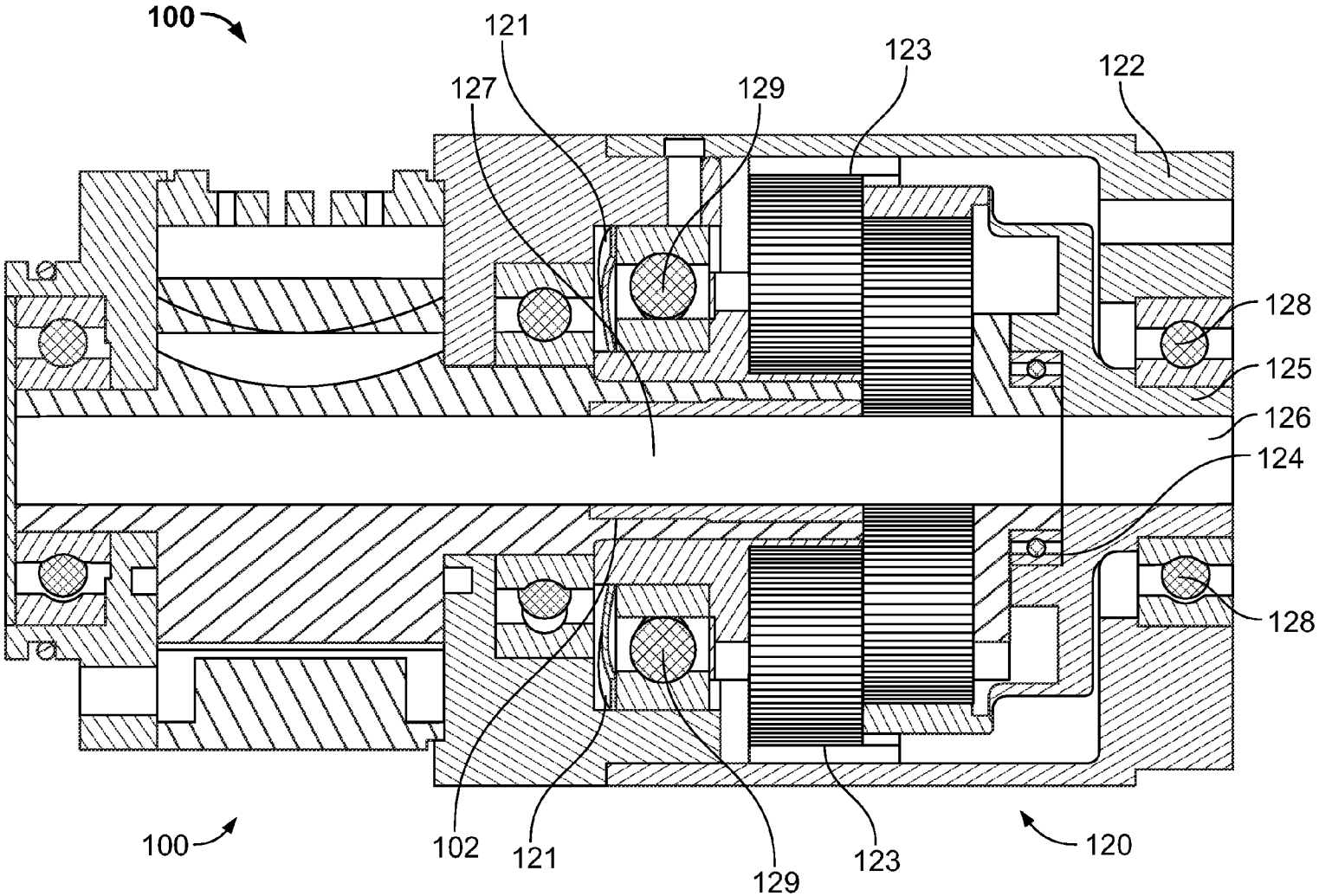
FIG. 5B is a sectional view taken along the line A-A of the combined air motor assembly and gear reducer assembly of FIG. 5A.

Preferably, air motor assembly 100 is operably engaged with gear reducer assembly 120 to form an integral unit with a wave washer 121 disposed therebetween, as shown in FIGS. 5A and 5B. Gear reducer assembly 120 is configured to transmit the rotational force of drive shaft 102 to driver blade 44 while at the same time effectively reducing the rotational speed and increasing the torque produced by drive shaft 102.

Because drive shaft 102 of air motor assembly 100 rotates at such a relatively high speed (on the order of 800 RPM), it is necessary to reduce the effective rotational speed of drive shaft 102 in order to drive fastener 10. Advantageously, gear reducer assembly 120 also increases the torque provided by drive shaft 102 to allow fastener 10 to be driven into relatively hard substrate materials. Unlike prior art pneumatic fastener driving tools, gear reducer assembly 120 of the present invention is fixed in a stationary location within housing 2. In this manner, gear reducer assembly 120 does not travel linearly within tool 1, thereby reducing recoil generated during operation of tool 1.

The general design of gear reducer assembly 120 is known to those skilled in the art. A ring gear 122 surrounds a pair of planetary gears 123 mounted to a carrier 124. Carrier 124 is operatively connected to an output gear 125, such that carrier 124 drives output gear 125. Drive shaft 102 of air motor assembly 100 is operatively connected to planetary gears 123 such that drive shaft 102 serves as the "sun" gear about which planetary gears 123 rotate within ring gear 122 while ring gear 122 remains stationary. In the preferred embodiment, each of the planetary gears 123 comprises a compound planetary gear as is generally known in the art.

Known prior art pneumatic fastener driving tools employ multiple sets of single (non-compound) planetary gears in order to sufficiently reduce the effective rotational speed of drive shaft 102 and increase the torque provided by drive shaft 102. However, multiple sets of single (non-compound) planetary gears necessarily increase the overall length of such tools which adds bulk and weight and which increases the effect of the recoil produced by such prior art tools. By using a pair of compound planetary gears, the both the overall length of tool 1 of the present invention, and the effect of any recoil generated by the tool, may be advantageously reduced.

Gear reducer assembly 120 further comprises a shaft 127 formed along the central longitudinal axis of gear reducer assembly 120 and extending therethrough. Shaft 127 is configured to allow drive shaft 102 to enter gear reducer assembly 120 and to permit passage and independent movement of driver blade 44 in both a linear (axial) and rotational manner in and through the interior portion of gear reducer assembly 120.

Additionally, output gear 125 is formed with an axial bore 126 extending therethrough to permit passage of driver blade 44 and to allow driver blade 44 to independently move in a linear (axial) manner through bore 126. As shown in FIGS. 5A and 5B, bore 126 in one embodiment is formed with a D-shaped profile (that is, a profile having both curved surface and a flat surface) configured to engage the D-shaped profile of second zone 48 of driver blade 44 such that output gear 125 rotationally drives driver blade 44. However, it will be appreciated by those skilled in the art that second zone 48 of driver blade 44 and bore 126 of output gear 125 need not be D-shaped. Second zone 48 and bore 126 may be formed of any geometrically-keyed profiles that allow torque to be transferred from output gear 125 to driver blade 44.

A plurality of upper ball bearings 128 (disposed within a channel formed in the front of gear reducer assembly 120) extend around output gear 125, maintain the position of output gear 125 and permit output gear 125 to rotate within gear reducer assembly 120. A plurality of lower ball bearings 129 (disposed within a channel formed in the rear of gear reducer assembly 120) extend around carrier 124, maintain the position of carrier 124 and permit rotation of carrier 124 within gear reducer assembly 120.

As shown in FIG. 1, tool 1 of the present invention further comprises a nose piece 140 attached to the front of housing 2. Nose piece 140 is formed with a passage 141 extending through nose piece 140 along the central longitudinal axis of nose piece 140 and in axial alignment with axial bore 126 of output gear 125. Passage 141 is a generally cylindrical shaft configured to permit passage and independent movement of driver blade 44 in both a linear (axial) and rotational manner in and through the interior portion of nose piece 140. Passage 141 terminates at an opening 142 formed at the front of nose piece 140.

Figure 6:
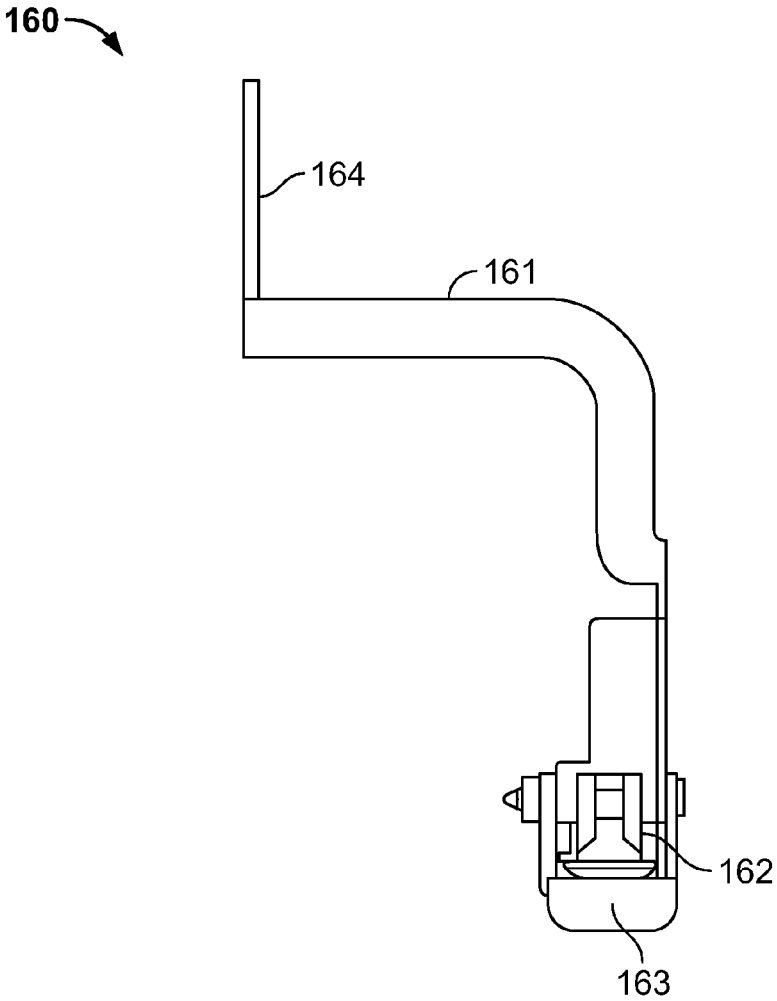
FIG. 6 is an enlarged top view of the workpiece contact assembly.

As shown in FIGS. 1 and 6, a workpiece contact assembly 160, as is generally known in the art, is mounted to nose piece 140 and extends outwardly therefrom. Workpiece contact assembly 160 comprises a yolk 161 having an engagement arm 164 formed on one end and a jaw assembly 162 formed on the other end. Jaw assembly 162 is configured to provide a guiding passageway 165 through which fastener 10 travels when it is driven by driver blade 44. Jaw assembly further comprises a no-mar tip 163 configured to engage the exterior surface of the surface material without damaging the surface thereof.

Workpiece contact assembly 160 is configured to axially slide relative to nose piece 140 and to cooperate with a depth adjustment assembly 9 (as is known in the art) in order to adjust the depth of the fastener insertion into the surface and substrate materials by tool 1. The interaction of workpiece contact assembly 160 and depth adjustment assembly 9 is well known in the art.

Workpiece contact assembly 160 is further configured such that when tool 1 is forced against the exterior surface of the surface material, in preparation for driving a fastener, workpiece contact assembly slides axially relative to nose piece 140 thereby forcing engagement arm 164 into engagement with mechanisms (not shown) within tool 1 to permit actuation of tool 1.

Figure 7:
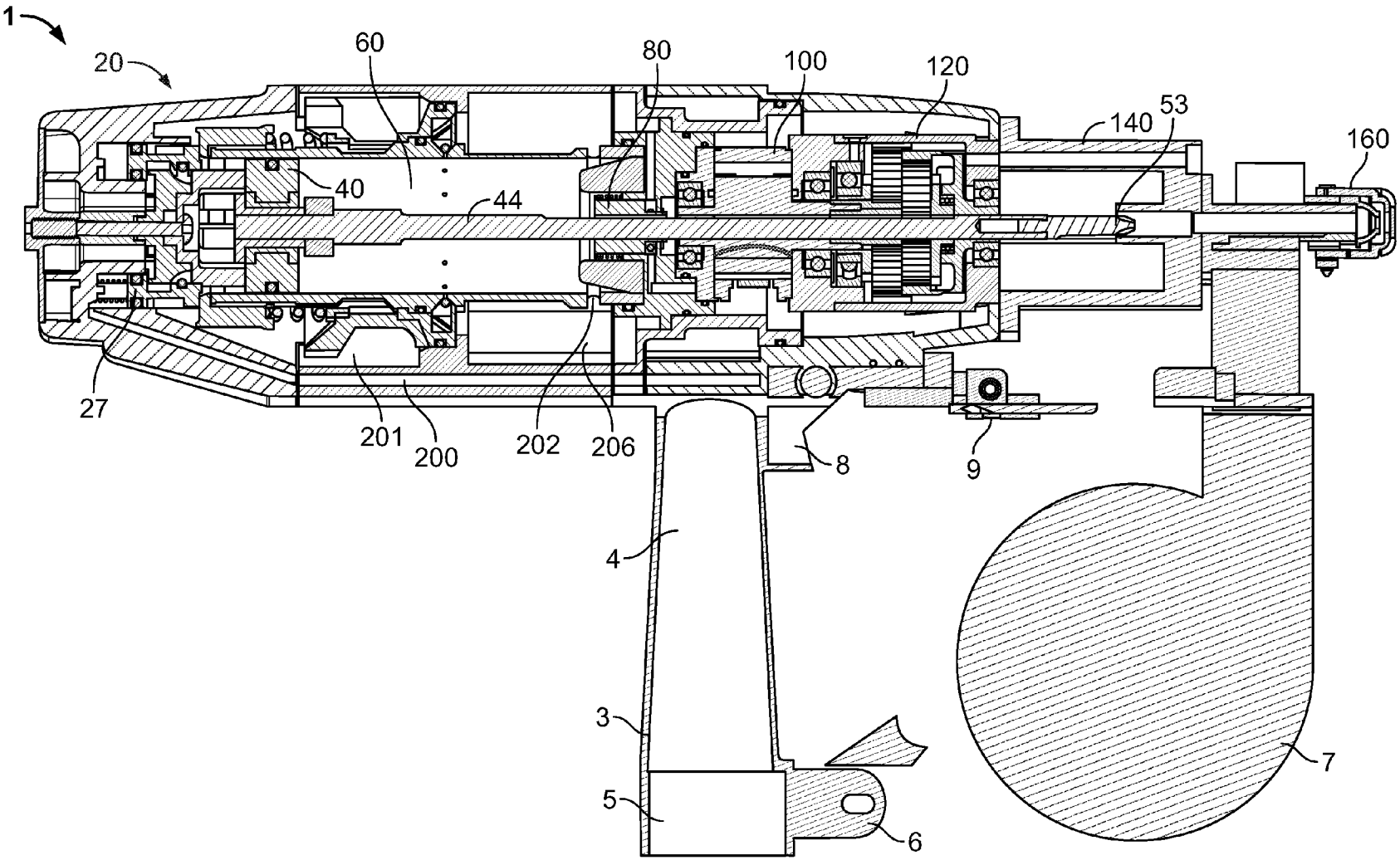
FIG. 7 is a sectional view of the tool of the present invention in a "non-actuated" state; and, FIG. 8 is a sectional view of the tool of the present invention in an "actuated" state.
Figure 8:
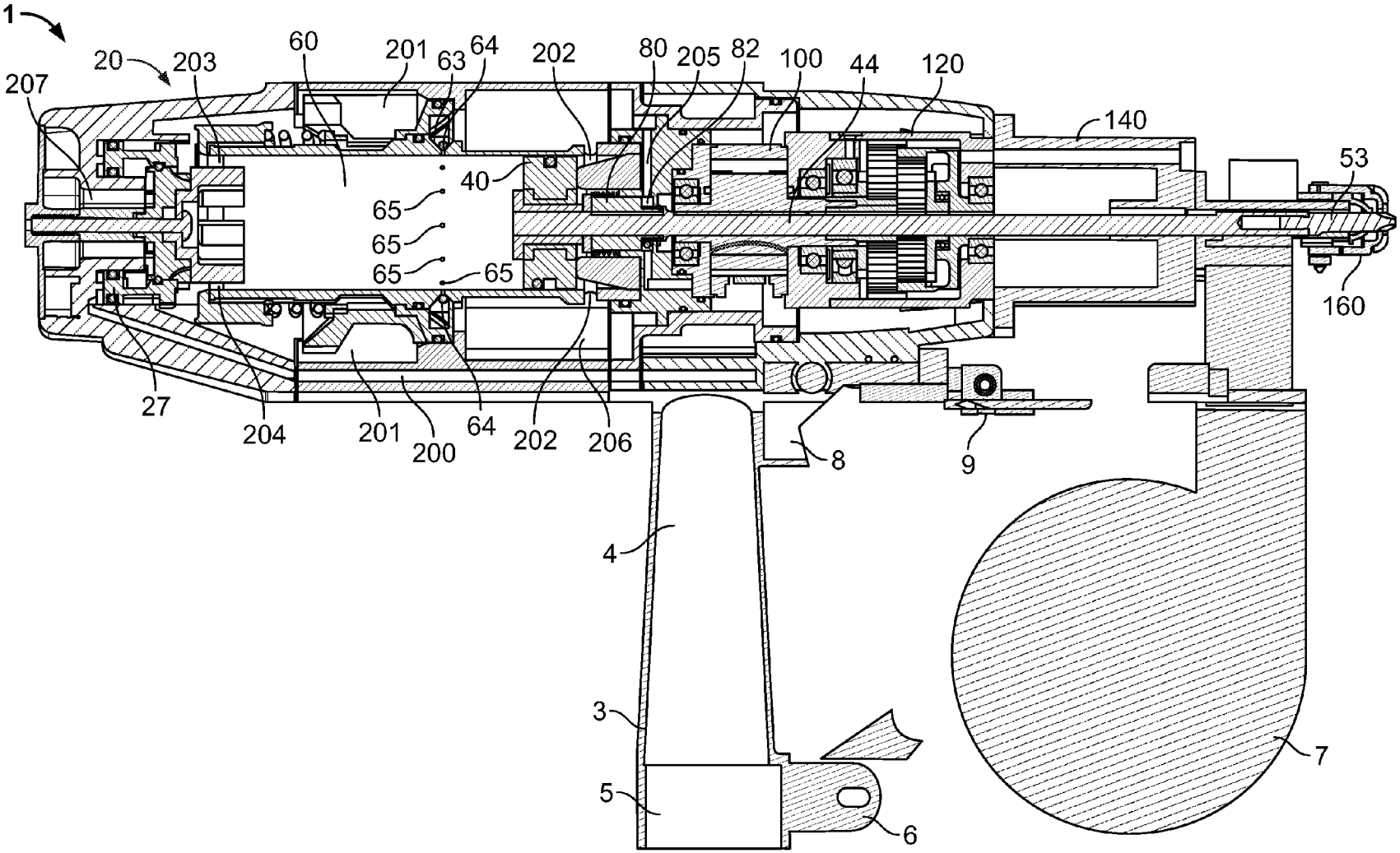

The operation of tool 1 is depicted in FIGS. 7 and 8 and is described as follows. FIG. 7 shows tool 1 in its "non-actuated" or rest state. In its "non-actuated" state, tool 1 is connected to a source of pressurized air (not shown) through adapter 5 of handle 3. The pressurized air fills cavity 4 formed in handle 3 as well as passageway 200 which is formed in housing 2 and which is in pneumatic communication with cavity 4 and transports pressurized air from cavity 4 to chamber 27 adjacent to poppet valve 24 in poppet valve assembly 20. In this manner, as discussed above, poppet valve 24 is biased in its closed position by the force of the pressurized air contained in chamber 27 and no pressurized air is permitted to enter air chamber 60.

Also in pneumatic communication with cavity 4 is a chamber 201 formed within housing 2 and disposed outside of air chamber 60. Chamber 201 is configured to hold a quantity of pressurized air received from cavity 4 and to transport pressurized air from cavity 4 into air chamber 60 when poppet valve 24 is open, as further discussed below.

In the "non-actuated" state, piston 41 of driver blade assembly 40 is in a fully retracted position within air chamber 60 and rests against bumper 31 of poppet valve assembly 20.

Driver blade 44 extends through air chamber 60, spool valve assembly 80, air motor assembly 100, gear reducer assembly 120 and partially through nose piece 140. Neither driver blade 44 nor driving bit 53 extends outside of nose piece 140 when tool 1 in is the "non-actuated" state.

FIG. 8 shows tool 1 in an "actuated" state. In order to actuate tool 1 for the purposes of driving a fastener (assuming tool 1 is positioned against a surface material and engagement arm 164 of workpiece contact assembly 160 has engaged the required mechanisms to permit actuation of tool 1) trigger 8 is depressed by a user. When trigger 8 is depressed, trigger 8 stops the flow of pressurized air from the source of pressurized air to chamber 27 of poppet valve assembly 20 and opens passageway 200 to the atmosphere. In this manner, the pressurized air in air chamber 27 and passageway 200 is permitted to exit tool 1. Without the force of the pressurized air in chamber 27 to hold it closed, poppet valve 24 opens, as shown in FIG. 8.

When poppet valve 24 opens, it opens channels 203, 204 at the end proximate end of air chamber 60. Channels 203, 204 are in pneumatic communication with chamber 201 through passageways (not shown) formed in housing 2 such that the pressurized air in chamber 201 is directed into air chamber 60 through channels 203, 204 and behind piston 41 of driver blade assembly 40. The air entering air chamber 60 through channels 203, 204 exerts pressure against the top surface of piston 41 and forces piston 41 to begin to move linearly through air chamber 60. Air present in air chamber 60 below piston 41 is allowed to exit air chamber 60 through openings 202 and into chamber 206 formed in housing 2.

As piston 41 travels through air chamber 60, it drives driver blade 44 in a linear manner through air chamber 60, spool valve assembly 80, air motor assembly 100, gear reducer assembly 120 and nose piece 140. When driving bit 53 extends outside nose piece 140, it engages a fastener supplied by fastener magazine 7 and held in jaw assembly 162 of workpiece contact assembly 160. The linear movement of driver blade 44 disengages the fastener from the carrier strip and drives it through workpiece contact assembly 160 and into the surface and substrate materials.

When piston 41 is fully extended within air chamber 60 such that it abuts piston bumper 62 disposed at the distal end of air chamber 60, air pressure rapidly builds in air chamber 60 behind piston 41. The building air pressure enters holes 65 in air chamber 60 and exerts outward pressure on O-ring 64 thereby slightly displacing O-ring 64 and allowing the pressurized air to exit holes 65. Holes 65 are in pneumatic communication with passageways (not shown) formed in housing 2 that lead to channel 205. Channel 205 directs the pressurized air to inlet ports 82 of spool valve 81.

As discussed above, spool valve 81 is biased in an open position and, therefore, the pressurized air delivered to inlet ports 82 of spool valve 81 is transported to air motor 101 of air motor assembly 100. The flow of pressurized air to air motor 101 activates air motor 101 and causes it to rotatably drive drive shaft 102. Drive shaft 102, in turn, engages gear reducer assembly 120 and drives output gear 125, as discussed above.

Output gear 125 drives driver blade 44 by means of D-shaped axial bore 126 through which the D-shaped second zone 48 of driver blade 44 extends and matingly engages. In this manner, driver blade 44 is rotatably driven (while piston 41 does not rotate) in order to further drive the fastener into the surface and substrate materials and to secure the surface material to the substrate material.

At the same time driver blade 44 is being rotationally driven the air pressure in air chamber 60 exerts a force on the top of locking plate 55 of driver blade assembly 40. Since piston 41 is already fully extended within air chamber 60 and rests against piston bumper 62, the force exerted on the top of locking plate 55 forces driver blade 44 to slide axially through piston 41 until the bottom side of locking plate 55 abuts the top side of piston 41.

Such axial movement of driver blade 44 through piston 41 serves two purposes. First, it serves to further extend driving bit 53 outside of workpiece contact assembly 160 in order to maintain engagement of the fastener as it is rotationally driven. Second, as driver blade 44 moves axially through the stationary piston, first zone 49 of driver blade 44 engages spool valve assembly 80 and actuates spool valve 81 by causing spool valve 81 to axially move into a "closed" position, thereby cutting off the flow of pressurized air to air motor 101. When the flow of pressurized air to air motor 101 is terminated, air motor 101 stops and the rotational movement of driver blade 44 ceases. At this point, the fastener is fully driven into the surface and substrate materials.

To return tool 1 back to the "non-actuated" state in preparation for driving the next fastener, trigger 8 is released. When trigger 8 is released, the flow of pressurized air from the source of pressurized air to chamber 27 of poppet valve assembly 20 is restored and poppet valve 24 is forced closed, thereby sealing air chamber 60.

The air present in air chamber 60 above piston 41 is allowed to exit air chamber 60 through a small diameter air escape hole 207 leading to vents 23 of poppet valve assembly 20. Escape hole 207 is of sufficiently small diameter to discharged pressurized air into the atmosphere little by little without affecting the piston driving operation by means of pressurized air. At the same time, a source of pressurized air is directed to air chamber 60 below piston 41 through openings 202 which receives the pressurized air via chamber 206.

The pressurized air below piston 41 in combination with reduced pressure of the air above piston 41 (due to venting of the air above piston 41 through escape hole 207 and vents 23) causes piston 41 to retract from its fully extended position and return to its fully retracted position, thereby retracting driver blade 44 and returning tool 1 to its "non-actuated" state.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A pneumatic fastener driving tool for driving a fastener using linear and rotational motion, comprising:

a housing;

a poppet valve assembly;

a driver blade assembly;

an air chamber;

a spool valve assembly;

an air motor assembly; and, a gear reducer assembly, the poppet valve assembly, the driver blade assembly, the air chamber, the spool valve assembly, the air motor assembly, and the gear reducer assembly all disposed within the housing, wherein the driver blade assembly is at least partially disposed within the air chamber and the poppet valve assembly is configured to sealingly engage the air chamber, the air chamber disposed between the poppet valve assembly and the air motor assembly, wherein the air motor assembly is annularly disposed about the driver blade assembly and is engageable with the driver blade assembly, wherein the air motor assembly and the gear reducer assembly are fixed in a stationary position within the housing and relative to the housing during actuation of the tool, and wherein the driver blade assembly is non-rotatably driven a first distance and is then rotatably driven a second distance beyond the first distance.

2. The pneumatic fastener driving tool of claim 1 wherein the gear reducer assembly is fixed in a stationary position within the housing.

3. The pneumatic fastener driving tool of claim 1 wherein the driver blade assembly comprises a driver blade, and wherein the driver blade assembly, the spool valve assembly and the air motor assembly each comprise an axial bore extending therethrough and configured to receive the driver blade therein and to permit the driver blade to independently move in a linear and rotational manner within the driver blade assembly, the spool valve assembly and the air motor assembly.

4. The pneumatic fastener driving tool of claim 1 wherein the driver blade assembly comprises a driver blade, and wherein the gear reducer assembly comprises an output gear formed with an axial bore extending therethrough and configured to receive the driver blade therein and rotationally drive the driver blade, and to permit the driver blade to independently move in a linear manner within the gear reducer assembly.

5. The pneumatic fastener driving tool of claim 4 wherein the axial bore and the driver blade comprise geometrically-keyed profiles.

6. The pneumatic fastener driving tool of claim 1 wherein the housing comprises an integral handle extending generally downwardly therefrom and having a hollow interior cavity formed therein, the handle further comprising an adapter for receive a source of pressurized air.

7. The pneumatic fastener driving tool of claim 1 further comprising a trigger mounted to the housing, the trigger configured to control a flow of pressurized air to the poppet valve assembly.

8. The pneumatic fastener driving tool of claim 1 further comprising a detachable fastener magazine.

9. The pneumatic fastener driving tool of claim 1 wherein the poppet valve assembly comprises a cap member, a poppet valve disposed within the cap member, an exhaust plate mounted to the cap member and at least one vent formed in the exhaust plate and configured to permit a quantity of air to be exhausted from the air chamber.

10. The pneumatic fastener driving tool of claim 9 wherein the poppet valve is configured to control a flow of air into the air chamber.

11. The pneumatic fastener driving tool of claim 1 wherein the driver blade assembly comprises a piston having an axial bore extending therethrough, a bushing disposed in the axial bore and a driver blade disposed within the bushing and extending therethrough, the driver blade configured to independently move in a linear and rotational manner within the piston.

12. The pneumatic fastener driving tool of claim 11 wherein the driver blade comprises at least one zone formed along a length of the driver blade, the at least one zone having a geometrically-keyed profile.

13. The pneumatic fastener driving tool of claim 11 wherein the piston is configured to linearly drive the driver blade.

14. The pneumatic fastener driving tool of claim 1 wherein the air chamber comprises an annular groove disposed about a circumference of the air chamber and a plurality of holes extending from an interior area of the air chamber to an exterior area of the air chamber, the holes formed within the annular groove.

15. The pneumatic fastener driving tool of claim 14 wherein an O-ring is disposed within the annular groove, the O-ring configured to prevent a quantity of air in the exterior area from entering the interior area and to allow a quantity of air in the interior area to enter the exterior area.

16. The pneumatic fastener driving tool of claim 1 wherein the spool valve assembly comprises a spool valve configured to control a flow of air to the air motor assembly.

17. The pneumatic fastener driving tool of claim 1 wherein the air motor assembly comprises a vane-type air motor operatively connected to a drive shaft and configured to rotatably drive the draft shaft.

18. The pneumatic fastener driving tool of claim 1 wherein the gear reducer assembly comprises a ring gear, a sun gear and a pair of compound planetary gears, the compound planetary gears mounted to a carrier and the carrier operatively connected to an output gear configured to rotationally drive a driver blade.

19. The pneumatic fastener driving tool of claim 1 further comprising a nose piece.

20. The pneumatic fastener driving tool of claim 1 further comprising a workpiece contact assembly.

21. A method for securing a surface material to a substrate material using a pneumatic fastener driving tool, the method comprising the steps of:

providing a pneumatic driving tool, the tool comprising a housing, a poppet valve assembly, a driver blade assembly, an air chamber, a spool valve assembly, an air motor assembly, and a gear reducer assembly, wherein the air motor assembly is fixed in a stationary position within the housing;

providing a fastener;

non-rotatably driving the fastener a first distance into the surface material and the substrate material; and rotatably driving the fastener a second distance beyond the first distance into the surface material and the substrate material.

22. The method for securing a surface material to a substrate material using a pneumatic fastener driving tool of claim 21 wherein the gear reducer assembly is fixed in a stationary position within the housing.

* * * * *